US006247402B1

(12) United States Patent
Iijima et al.

(10) Patent No.: US 6,247,402 B1
(45) Date of Patent: Jun. 19, 2001

(54) INK RAIL FOR PRINTING PRESS

(75) Inventors: Takashi Iijima, Yokosuka; Hiroji Yoshida, Kawasaki; Yosho Kobayashi, Tokyo, all of (JP)

(73) Assignee: Kabushiki Kaisha Tokyo Kikai Seisakusho, Tokyo (JP)

( * ) Notice: Subject to any disclaimer, the term of this patent is extended or adjusted under 35 U.S.C. 154(b) by 0 days.

(21) Appl. No.: 09/415,215

(22) Filed: Oct. 12, 1999

(30) Foreign Application Priority Data

Jun. 15, 1999 (JP) ..... 11-167618

(51) Int. Cl.[7] ..... B41F 31/05; B41F 31/02; B41F 31/08

(52) U.S. Cl. ..... 101/365; 101/366; 101/351.8

(58) Field of Search ..... 101/351.8, 366, 101/365, 350.1, 350.6

(56) References Cited

U.S. PATENT DOCUMENTS 6,062,139 * 5/2000 Tomita et al. ..... 101/365
6,073,557 * 6/2000 Hachiya et al. ..... 101/365
6,116,595 * 9/2000 Garris et al. ..... 101/366

FOREIGN PATENT DOCUMENTS 1-229633 10/1996 (JP) .

* cited by examiner

*Primary Examiner*—Daniel J. Colilla
(74) *Attorney, Agent, or Firm*—Foley & Lardner

(57) ABSTRACT

An ink rail 1 for a printing press has an ink rail body 5 having an ink supplying surface 53 constucted by a concave curved surface able to be opposed to the outer circumferential surface of the fountain roller F at a suitable distance C; an inclination member 4 arranged on a lower face of the ink rail body 5 and having an angle of inclination a between upper and lower faces of the inclination member and an inclining direction set to a transversal direction of the ink rail body 5; a pedestal 3 for supporting the inclination member 4; a supporting member 2 for supporting the pedestal 3; first adjusting means 6 capable of moving the ink supplying surface 53 in a thickness direction of the inclination member 4 with respect to the outer circumferential surface of the fountain roller F; and second adjusting means 7 capable of moving the ink supplying surface 53 in a direction perpendicular to a moving direction provided by the first adjusting means with respect to the outer circumferential surface of the fountain roller F. The distance between the outer circumferential surface of the fountain roller F and the ink supplying surface 53 can be adjusted.

4 Claims, 4 Drawing Sheets

INK RAIL FOR PRINTING PRESS

BACKGROUND OF THE INVENTION

1. Field of the Invention

This invention relates to an ink rail for supplying ink to a fountain roller in an ink supplying device of a printing press.

2. Description of the Background Art

Many ink rails of an ink supplying device are conventionally known as shown in Japanese Patent Laid-Open Publication No. 1-229633 (prior art 1), etc. Namely, an ink rail body of an ink rail is opposed to an outer circumferential surface of a fountain roller so as to cover this outer circumferential surface. An ink supplying surface as a concave curved surface for supplying ink and having a relatively long arc is formed along the outer circumferential surface of the fountain roller. An ink supplying pipe is normally connected to the ink rail body and extends from an ink pump for supplying the ink to a side opposed to the ink supplying surface as a concave curved face. An ink discharge port is opened to an ink supplying surface side. An ink guide path for connecting the ink supplying pipe and the ink discharge port is arranged between the ink supplying pipe and the ink discharge port.

The ink sent out by the ink pump reaches the ink discharge port through the ink guide path, and is transferred to the outer circumferential surface of the fountain roller by rotating the fountain roller. The ink is further transferred to a roller arranged downstream in contact with the fountain roller.

The ink rail is constructed such that the ink supplying surface can be separated from the outer circumferential surface of the fountain roller to clean the ink supplying surface, etc. For example, in a device disclosed in Japanese Patent Laid-Open Publication No. 1-229633 (U.S. Pat. No. 2,567,269) as the prior art 1, a supporting member is supported by bearings arranged in both end portions in a longitudinal direction of the supporting member and having an eccentric structure able to be angularly displaced. The ink rail body is arranged on an adjusting guide face of a pedestal arranged in the supporting member so as to adjust a movement of the ink rail body. This device is constructed such that the ink supplying surface arranged in the ink rail body can be opposed to the outer circumferential surface of the fountain roller at a suitable distance in an operating position, and can be selectively located between the operating position in proximity to the outer circumferential surface of the fountain roller and an unoperating position separated from the outer circumferential surface of the fountain roller.

The distance between the ink supplying surface of the ink rail body and the outer circumferential surface of the fountain roller is adjusted by moving a supporting position of the supporting member. The supporting position of the supporting member is moved by approaching and separating the ink rail body attached to the adjusting guide face of the pedestal arranged in the supporting member with respect to the outer circumferential surface of the fountain roller, and angularly displacing the bearings of the eccentric structure.

In the ink rail disclosed in the. prior art 1, the ink can be supplied over the entire width of a printing face. However, in the conventional ink rail in the printing press capable of performing a printing operation to wide web paper, the length of an arc of the ink supplying surface of the ink rail body is relatively long and mass of the ink rail body is increased in giving rigidity to this ink rail body so that operability is bad. While the printing press is used for a long time, the ink rail is flexed by a secular distortion. Further, the inkrail rail is flexed by the influence of a pressure caused by the ink existing within a distance formed between the ink supplying surface and the outer circumferential surface of the fountain roller during the operation of the printing press. Thus, with respect to a slight distance to be precisely set and maintained between the outer circumferential surface of the fountain roller and the ink supplying surface of the ink rail body having the relatively long arc, a distance near an end portion of the ink rail in its longitudinal direction and a distance near a central portion and its peripheral portion are gradually different from each other. As a result, a problem exists in that the ink supply becomes unstable and printing quality is reduced.

When the ink supplying surface is constructed by the concave curved surface having the relatively long arc, upper and lower end portions of the arc of the ink supplying surface in its longitudinal direction easily come in contact with the outer circumferential surface of the fountain roller during an adjusting operation when the distance is adjusted by a combination of the movement of the ink rail body on the supporting member and the movements of angular displacement centers of the eccentric bearings of the supporting member. Accordingly, a problem exists in that skill is greatly required and a long working time is required.

Further, in a worst case, there is a possibility of mutual damage caused by operating the printing press while the ink supplying surface of the ink rail body comes in contact with the outer circumferential surface of the fountain roller.

To prevent occurrences of these problems, the supporting member and the ink rail body are reprocessed and new parts are exchanged and attachments of the respective members are readjusted and reassembled, etc. so that large repair countermeasures are required. In addition to this, when the ink rail body is assembled into the supporting member, it is difficult to determine a reference position of the ink rail body and skill is required in working of this determination so that it takes much time to make this work.

SUMMARY OF THE INVENTION

To solve the above problems, the present invention proposes an ink rail for a printing press capable of selecting an operating position in proximity to an outer circumferential surface of a fountain roller and an unoperating position separated from the outer circumferential surface of the fountain roller, the ink rail comprising an ink rail body having at least a length corresponding to a printing width of the printing press, and having an ink discharge port and an ink supplying surface constructed by a concave curved surface able to be opposed to the outer circumferential surface of the fountain roller at a suitable distance; an inclination member arranged on a lower face of the ink rail body and having an angle of inclination between upper and lower faces of the inclination member and an inclining direction set to a transversal direction of the ink rail body; a pedestal for supporting the inclination member; a supporting member for supporting the pedestal; first adjusting means for moving the inclination member with respect to the pedestal and capable of moving the ink supplying surface of the ink rail body in a thickness direction of the inclination member with respect to the outer circumferential surface of the fountain roller; and second adjusting means for moving the ink rail body with respect to the inclination member and capable of moving the ink supplying surface of the ink rail body in a direction perpendicular to a moving direction provided by the first adjusting means with respect to the outer circumferential surface of the fountain roller; the distance between the outer circumferential surface of the fountain roller in the operating position of the ink rail and the ink supplying surface of the ink rail body being able to be adjusted by operating the first and second adjusting means.

The present invention also proposes an ink rail for a printing press capable of selecting an operating position in proximity to an outer circumferential surface of a fountain roller and an unoperating position separated from the outer circumferential surface of the fountain roller, the ink rail comprising an ink rail body having at least a length corresponding to a printing width of the printing press, and having an ink discharge port and an ink supplying surface constructed by a concave curved surface able to be opposed to the outer circumferential surface of the fountain roller at a suitable distance; an inclination member arranged on a lower face of the ink rail body and having an angle of inclination between a lower face of the inclination member and an upper face of the inclination member set to be horizontal in the operating position, and also having an inclining direction set to a transversal direction of the ink rail body; a pedestal for supporting the inclination member; a supporting member for supporting the pedestal; first adjusting means capable of moving the ink supplying surface of the ink rail body in a vertical direction with respect to the outer circumferential surface of the fountain roller by moving the inclination member in a slanting vertical direction with respect to the pedestal; and second adjusting means capable of moving the ink supplying surface of the ink rail body in a horizontal direction with respect to the outer circumferential surface of the fountain roller by moving the ink rail body in the horizontal direction with respect to the inclination member; the distance between the outer circumferential surface of the fountain roller in the operating position of the ink rail and the ink supplying surface of the ink rail body being able to be adjusted by operating the first and second adjusting means.

In the above two ink rails for the printing press, the present invention further proposes that the ink rail body and the inclination member are divided into plural portions in a longitudinal direction of the fountain roller, and the distances between the outer circumferential surface of the fountain roller in the operating position of the ink rail and the ink supplying surfaces of the plural ink rail bodies can be individually adjusted.

DESCRIPTION OF THE PREFERRED EMBODIMENTS

Figure 1:
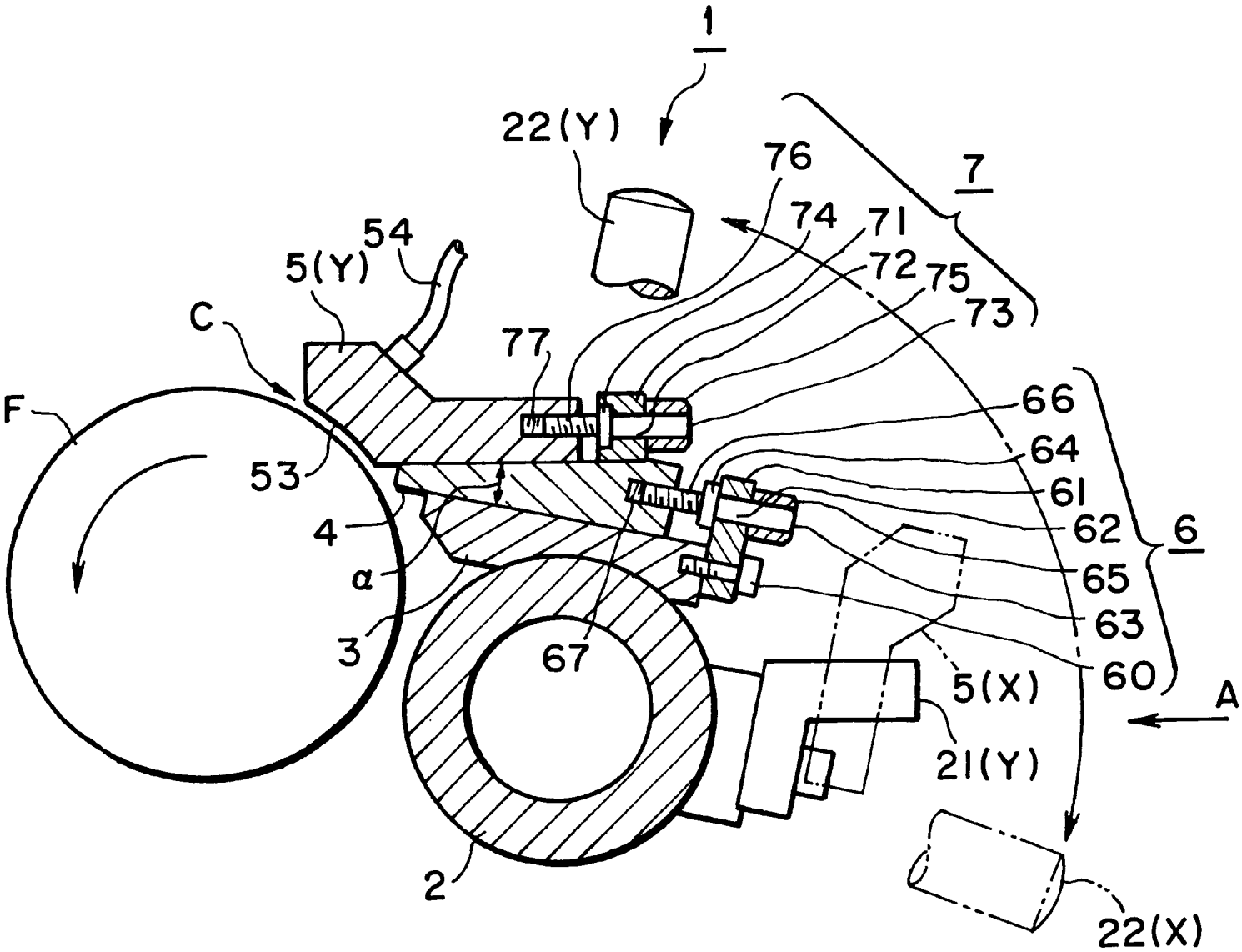
FIG. 1 is a transversal sectional view of an ink rail in a state in which first and second adjusting means of the ink rail common to first and second embodiment modes of the ink rail for a printing press in this invention are located in an operating position Y.
Figure 2:
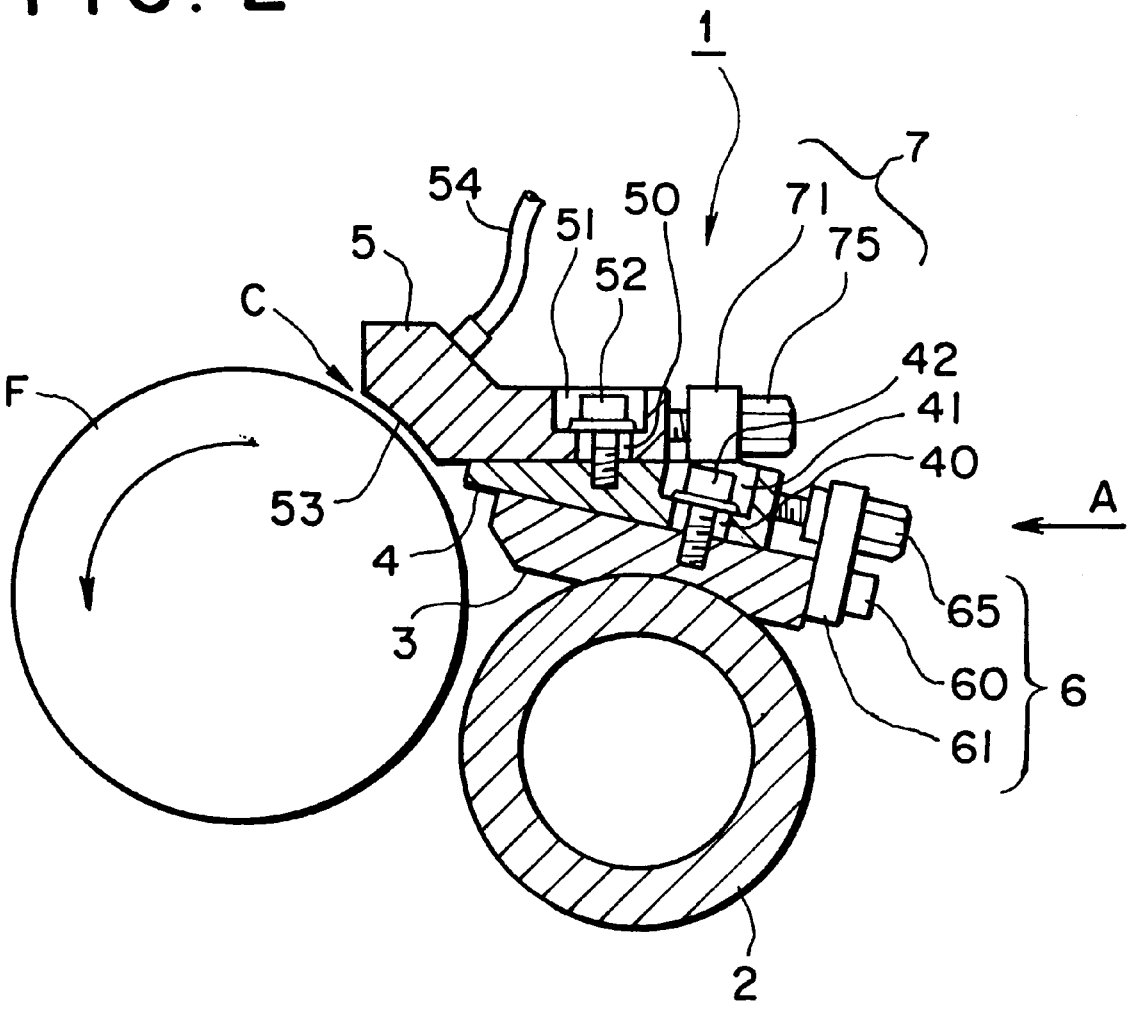
FIG. 2 is a sectional view of the ink rail in a state providing operating positions of a bolt, etc. in each of distance adjusting means of the ink rail common to the first and second embodiment modes.
Figure 3:
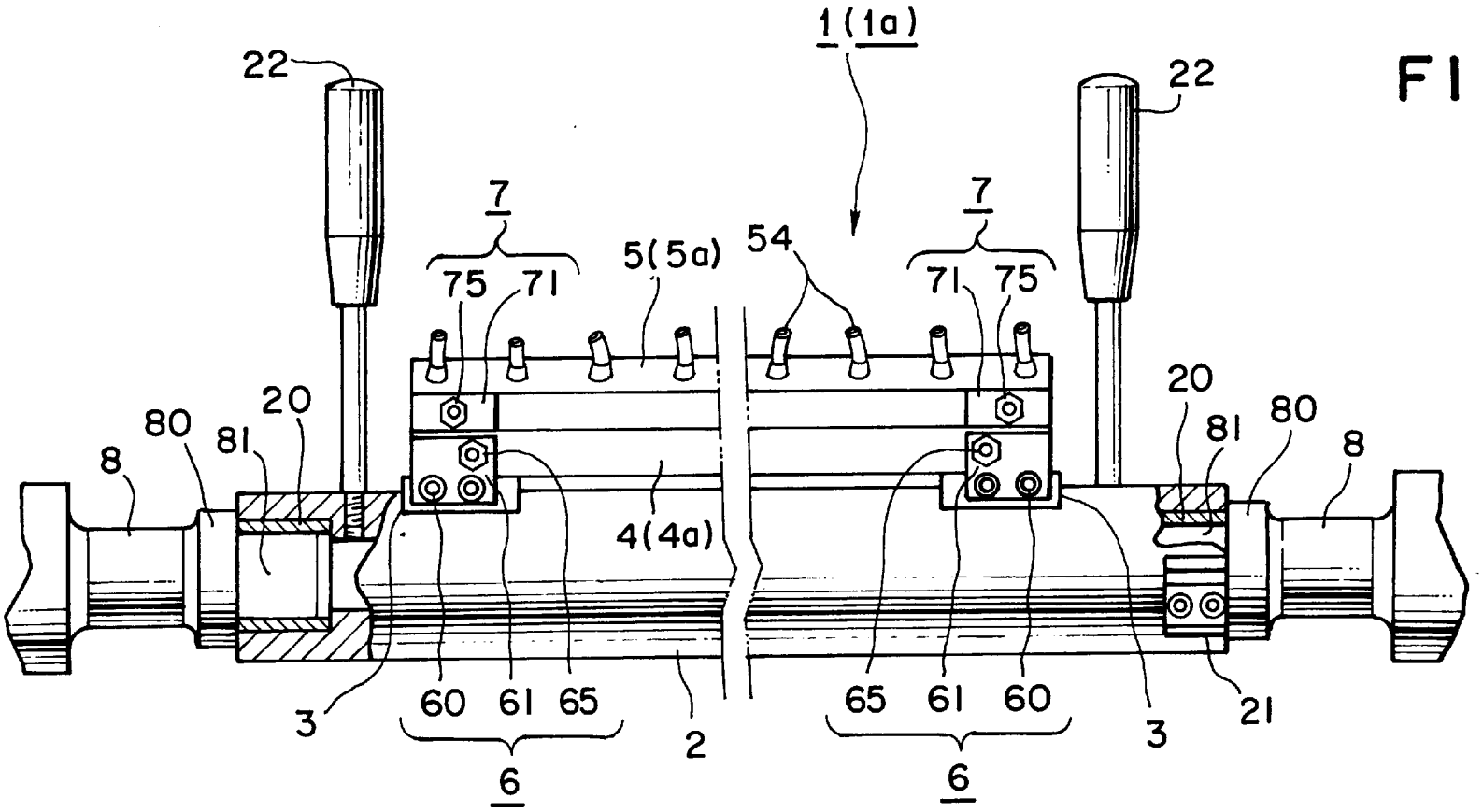
FIG. 3 is a view taken along an arrow A of FIGS. 1 and 2 and showing the ink rail in the first embodiment mode of this invention.
Figure 4:
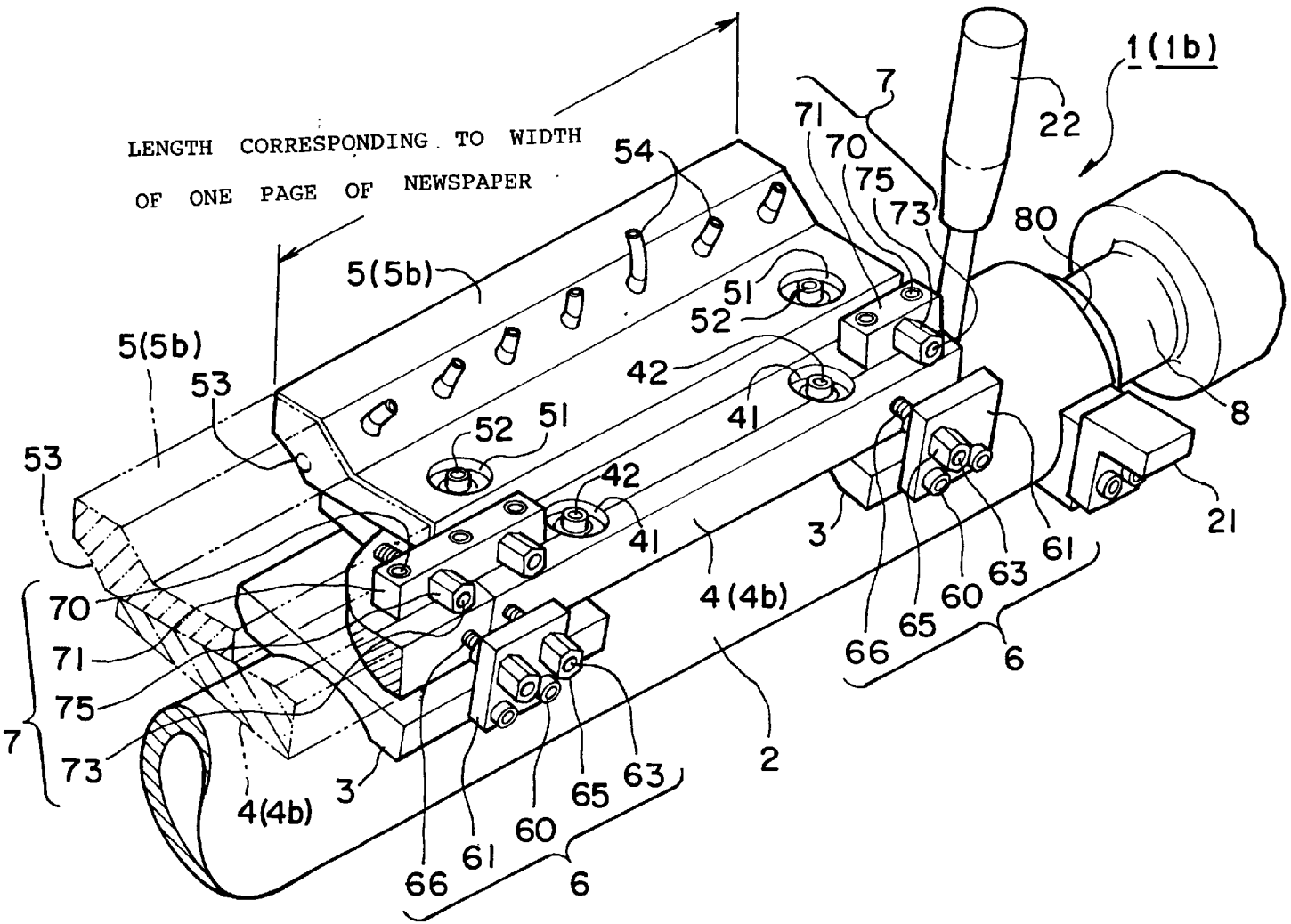
FIG. 4 is a partial perspective view in which an ink rail body is divided into portions of lengths each corresponding to one page width of a newspaper in the second embodiment mode of this invention and the ink rail is formed by connecting these divided portions to each other and is slantingly seen from above on an A-side of FIGS. 1 and 2.

The present invention will next be explained on the basis of FIGS. 1 to 4. FIG. 1 shows a transversal sectional view of an ink rail in a state in which first and second adjusting means of the ink rail common to first and second embodiment modes of the ink rail in this invention are located in an operating position Y. FIG. 2 shows a sectional view of the ink rail in a state providing operating positions of a bolt, etc. in each of distance adjusting means of the ink rail common to the first and second embodiment modes. FIG. 3 shows a view taken along an arrow A of FIGS. 1 and 2 and showing the ink rail in the first embodiment mode of this invention. FIG. 4 shows a partial perspective view in which an ink rail body is divided into portions of lengths each corresponding to one page width of a newspaper in the second embodiment mode of this invention and the ink rail is formed by connecting these divided portions to each other and is slantingly seen from above on an A-side of FIGS. 1 and 2.

An ink rail 1*a* in the first embodiment mode in this invention shown in FIGS. 1, 2 and 3 and an ink rail 1*b* in the second embodiment mode shown in FIGS. 1, 2 and 4 respectively have a supporting member 2, a pedestal 3, an inclination member 4, an ink rail body 5, a first adjusting means 6 and a second adjusting means 7.

In the ink rail 1*a* in the first embodiment mode of this invention, the inclination member 4*a* and the ink rail body 5*a* are respectively constructed by integral plate-shaped bodies extending in longitudinal directions of a fountain roller F and the supporting member 2. In the ink rail 1*b* in the second embodiment mode of this invention, the inclination member 4*b* and the ink rail body 5*b* are respectively constructed by plate-shaped bodies divided into plural portions in the longitudinal directions of the fountain roller F and the supporting member 2, and can be individually moved.

A common construction of the ink rail 1*a* of the first embodiment mode and the ink rail 1*b* of the second embodiment mode in this invention will be explained. The supporting member 2 is compact and light in weight and is approximately formed in a cylindrical shape having sufficient rigidity. The supporting member 2 is attached to frames on unillustrated both sides of the supporting member 2 through brackets 8. The supporting member 2 is parallel to the longitudinal direction of the fountain roller F and has a length longer than a face length of the fountain roller F. Bearings 20 are arranged in both end portions of the supporting member 2 and are respectively attached to shaft portions 81 through flanges 80 of the brackets 8. The supporting member 2 is restricted in the longitudinal direction and can be angularly displaced with respect to the fountain roller F.

An angular displacement limiting member 21 for positioning the ink rail body 5 in its operating position is arranged in the vicinity of each of both the end portions of the supporting member 2. The angular displacement limiting member 21 is fixed in a state in which an upper face of the angular displacement limiting member 21 hits against an unillustrated angular displacement limiting portion arranged in each frame. The angular displacement limiting portion 21 positions the ink rail body 5 in the operating position Y. The angular displacement limiting member 21 hits against an unillustrated stopper arranged in the frame and a position of this angular displacement limiting member 21 is limited when the ink rail body 5 is separated from an outer circumferential surface of the fountain roller F and is moved to an unoperating portion X to clean an ink supplying surface 53 of the ink rail body 5 and perform maintenance, etc.

An operating lever 22 is arranged in the vicinity of each of both the end portions of the supporting member 2. The supporting member 2 is angularly displaced by operating the operating lever 22 with respect to the fountain roller F so that the ink rail body 5 is easily moved between the operating position Y and the unoperating position X.

The pedestal 3 is arranged integrally with the supporting member 2 in a position near each of both the end portions of the supporting member 2 in its longitudinal direction. The pedestal 3 is arranged in the operating position Y shown in FIGS. 1 and 2 such that an end portion of the pedestal 3 on a side of the fountain roller F is highly inclined with respect to a lower face of the ink rail body 5 by, an angle of inclination $\alpha$ of the inclination member 4 nipped and arranged between the lower face of the ink rail body 5 and an upper face of the pedestal 3. An upper face of the inclination member 4 is set to be horizontal in the operating position Y by inclining the upper face of this pedestal 3. The number of pedestals 3 is set to two in FIGS. 3 and 4. However, the number of pedestals, lengths and widths of the pedestals may be suitably set. One pedestal or more are arranged in the longitudinal direction of the supporting member 2.

The inclination member 4 is overlapped and attached to the upper face of the pedestal 3. As shown in FIG. 3, the inclination member 4*a* of the first embodiment mode has a length slightly shorter than that of an unillustrated longitudinal face of the fountain roller F in the longitudinal direction of the supporting member 2 and is constructed by an integral plate-shaped body and is attached so as to be adjusted. As shown in FIG. 4, the inclination member 4*b* of the second embodiment mode is divided into plural portions each having a suitable width in the longitudinal direction of the supporting member 2, e.g., a length corresponding to one page unit of a newspaper. These plural portions are parallel with each other and are respectively individually attached so as to be adjusted.

The inclination member 4 is arranged on the lower face of the ink rail body, 5 so as to be adjusted such that the inclination member 4 approaches the outer circumferential surface of the fountain roller F and is separated from this outer circumferential surface. The inclination member 4 has the angle of inclination $\alpha$ between its upper and lower faces. An inclining direction of the inclination member 4 is set to a transversal direction (width direction) of the ink rail body 5. Namely, the inclination member 4 is formed in a trapezoidal shape or a wedge shape in section of the plate-shaped body in which an end tip side of the inclination member 4 on a side of the fountain roller F is set to have a minimum thickness and the thickness of the inclination member 4 is increased toward its rear end side. The inclination member 4 has a uniform portion in thickness near its rear end portion. Accordingly, when the upper face of the inclination member 4 is set to a horizontal state, the lower face of the inclination member 4 is set to a slanting face on which an end tip side of the slanting face is located in a high position.

Plural elongated bolt holes 40 and plural counterbore holes 41 are formed in upper and lower directions on a thick rear end portion side of the inclination member 4 and are respectively arranged in parallel with each other in the longitudinal direction. Each elongated bolt hole 40 is a hole formed on a lower face side of each counterbore hole 41 and extending from the lower face of the counterbore hole 41 to the lower face of the inclination member 4. The elongated bolt hole 40 is an elongated hole extending in a direction perpendicular to the longitudinal direction of the supporting member 2 and is longer than at least the diameter of a bolt 42. This elongated bolt hole 40 is set to have a length required to suitably adjust and set the distance C between the outer circumferential surface of the fountain roller F and the ink supplying surface 53 of the ink rail body 5.

The counterbore hole 41 is a circular recessed hole arranged on an upper face side of the elongated bolt hole 40 of the inclination member 4 and having a depth for burying a head portion of the bolt 42. The counterbore hole 41 has a diameter set such that the head portion of the bolt 42 and its washer do not hit against a side wall of the counterbore hole 41 even when the inclination member 4 is moved in a longitudinal range of the elongated bolt hole 40.

The ink rail body 5 is overlapped and attached to the upper face of the inclination member 4. As shown in FIG. 3, the ink rail body 5*a* of the first embodiment mode has a length slightly shorter than that of an unillustrated longitudinal face of the fountain roller F in the longitudinal direction of the supporting member 2 and is constructed by an integral plate-shaped body, and is attached so as to be adjusted. As shown in FIG. 4, the ink rail body 5*b* of the second embodiment mode is divided into plural portions each having a suitable width in the longitudinal direction of the supporting member 2, e.g., a length corresponding to one page unit of a newspaper. These plural portions are arranged in parallel with each other and are respectively individually. attached so as to be adjusted.

In the ink rail body 5, plural elongated bolt holes 50 and plural counterbore holes 51 are formed in a vertical direction on a rear end side reverse to an end tip side as a side of the fountain roller F and are respectively arranged in parallel with each other in the longitudinal direction. The ink rail body 5 is attached to the upper face of the inclination member 4 by bolts 52 so as to be adjusted. Each elongated bolt hole 50 is a hole arranged on a lower face side of each counterbore hole 51 and extending from the lower face of the counterbore hole 51 to a lower face of the ink rail body 5. The elongated bolt hole 50 is an elongated hole extending in a direction perpendicular to the longitudinal direction of the supporting member 2 and is longer than at least a diameter of each bolt 52. This elongated bolt hole 50 is set to have a length required to suitably adjust and set the distance C between the outer circumferential surface of the fountain roller F and the ink supplying surface 53 of the ink rail body 5.

The counterbore hole 51 is a circular recessed hole arranged on an upper face side of the elongated bolt hole 50 of the ink rail body 5 and having a depth for burying a head portion of the bolt 52. The counterbore hole 51 has a diameter set such that the head portion of the bolt 52 and its washer do not hit against a side wall of the counterbore hole 51 even when the ink rail body 5 is moved in a longitudinal range of the elongated bolt hole 50.

The ink rail body 5 has the ink supplying surface 53 in a position opposed to the outer circumferential surface of the fountain roller F. The ink supplying surface 53 is constructed by a concave curved surface corresponding to a convex curved surface as the outer circumferential surface of the fountain roller F. A small distance C precisely set between the ink supplying surface 53 and the outer circumferential surface of the fountain roller F is formed on the ink supplying surface 53 in the operating position Y and can be adjusted. Unillustrated plural ink discharge ports are opened to the ink supplying surface 53. Ink supplied through each of plural ink supplying pipes 54 is supplied to the outer circumferential surface of the fountain roller F. The length of an arc of the concave curved surface of the ink supplying surface 53 of the first and second embodiment modes is set to about ¼ to 1/36 times a circumferential length of the fountain roller F.

The first adjusting means 6 moves the inclination member 4 in a transversal direction of the ink rail body 5 along an upper face contact portion of the pedestal 3. Namely, the first adjusting means 6 moves the inclination member 4 slantingly upward and downward in a direction perpendicular to the longitudinal direction. The first adjusting means 6 has an adjusting shaft holding member 61, an adjusting shaft guide hole 62, an adjusting shaft 63, a flange 64, an adjusting member 65 and a male screw 66. The adjusting shaft holding member 61 is attached by bolts 60 to a rear end face of the pedestal 3 on a side opposed to a side of the fountain roller F. The adjusting shaft guide hole 62 is extended and bored in a transversal direction of the adjusting shaft holding member 61. The adjusting shaft 63 is inserted into the adjusting shaft guide hole 62. The flange 64 is arranged near the inclination member 4 of the adjusting shaft 63 so as to nip the adjusting shaft holding member 61. The adjusting member 65 is integrated with the adjusting shaft 63 on an opposite side of the flange 64 through the adjusting shaft holding member 61 to rotate this adjusting shaft 63. The male screw 66 is arranged on an extension line of the adjusting shaft 63 on its side of the inclination member 4. The male screw 66 of the first adjusting means 6 is screwed into a female screw 67 formed toward a transversal direction of the inclination member 4 on a rear end face of the inclination member 4 on its thick side.

The second adjusting means 7 moves the ink rail body 5 in a horizontal direction in a transversal direction of the ink rail body 5 along an upper face contact portion of the inclination member 4. The second adjusting means 7 has an adjusting shaft holding member 71, an adjusting shaft guide hole 72, an adjusting shaft 73, a flange 74, an adjusting member 75 and a male screw 76. The adjusting shaft holding member 71 is attached by bolts 70 from a rear portion side upper face of the inclination member 4 on a side opposed to the fountain roller F. The adjusting shaft guide hole 72 is extended and opened in a transversal direction of the adjusting shaft holding member 71. The adjusting shaft 73 is inserted into the adjusting shaft guide hole 72. The flange 74 is arranged near the ink rail body 5 of the adjusting shaft 73 so as to nip the adjusting shaft holding member 71. The adjusting member 75 is integrated with the adjusting shaft 73 on an opposite side of the flange 74 through the adjusting shaft holding member 71 to rotate the adjusting shaft 73. The male screw 76 is arranged on an extension line of the adjusting shaft 73 on its side of the ink rail body 5. The male screw 76 of the second adjusting means 7 is screwed into a female screw 77 formed toward a transversal direction of the ink rail body 5 on a rear end face of the ink rail body 5 on a side opposed to the fountain roller F.

The second embodiment mode of this invention shown in FIG. 4 is used in a newspaper printing press capable of printing web paper having a width of four pages of a newspaper. The inclination member 4*b* and the ink rail 5*b* are divided into four pairs each corresponding to one page width. Each of the inclination member 4*b* and the ink rail body 5*b* is moved in accordance with a width on each page so that each distance C can be individually adjusted.

An operation of this invention will next be explained. The ink rail 1 is in a state providing a position X shown by a two-dotted chain line in FIG. 1 as an unoperating position of the ink rail body 5. In this state, a bolt 42 is unfastened and the inclination member 4 is retreated in a direction separated from the outer circumferential surface of the fountain roller F. Thereafter, the bolt 42 is fastened and temporarily fixed so as not to move the inclination member 4 from this retreating position. Further, a bolt 52 is unfastened and the ink rail body 5 is retreated in a direction separated from the outer circumferential surface of the fountain roller F. Thereafter, the bolt 52 is fastened and temporarily fixed so as not to move the ink rail body 5 from this retreating position. Next, the operating lever 22 is angularly displaced from the position X of FIG. 1 to a position Y as an operating position. In this moving operation of the operating lever 22 to the position Y, the angular displacement limiting member 21 hits against an unillustrated angular displacement limiting portion. Therefore, no ink rail body 5 collides with the outer circumferential surface of the fountain roller F. The supporting member 2, the pedestal 3, the inclination member 4 and the ink rail body 5 are stopped in the position Y as the operating position shown in FIGS. 1 and 2 by moving the operating lever 22 from the position X to the position Y.

In this state, an end tip side of the pedestal 3 on a side of the fountain roller F is located in a position higher than that of a rear end side so that an upper face of the pedestal 3 is inclined. The upper face of the inclination member 4 attached to the upper face of the pedestal 3 is set to be horizontal by adjusting and setting an angle of inclination of the pedestal 3 to be equal to the angle of inclination $\alpha$ of the inclination member 4.

Next, the bolt 42 of the inclination member 4 is slightly unfastened and the inclination member 4 is set to a state capable of moving the inclination member 4 by a length of the elongated bolt hole 40 in its longitudinal direction along the upper face of the pedestal 3 to adjust the distance C between the outer circumferential surface of the fountain roller F and the ink supplying surface 53 of the ink rail body 5. Next, the adjusting member 65 of the first adjusting means 6 is rotated so that the inclination member 4 is advanced or retreated by rotating the male screw 66 screwed into the female screw 67. For example, when the distance C is narrowed, the inclination member 4 is advanced by rotating the adjusting member 65 leftward. In contrast to this, the inclination member 4 is retreated by rotating the adjusting member 65 rightward. Thus, the inclination member 4 is slantingly moved forward and backward along an inclination face of the pedestal 3. Accordingly, the ink supplying surface 53 of the ink rail body 5 relatively approaches the outer circumferential surface of the fountain roller F and is relatively separated from this outer circumferential surface and can be also changed in height. Thus, the ink supplying surface 53 can be adjusted in a thickness direction of the inclination member, i.e., a vertical direction. After this operation is performed, the bolt 42 is again softly fastened and temporarily fixed.

Next, the bolt 52 of the ink rail body 5 is slightly unfastened so that the ink rail body 5 is set to a state capable of moving this ink rail body 5 by a length of the elongated bolt hole 50 in its longitudinal direction along the upper face of the inclination member 4. Next, the adjusting member 75 of the second adjusting means 7 is rotated so that the ink rail body 5 is advanced toward the fountain roller F or is retreated from the fountain roller F by rotating the male screw 76 screwed into the female screw 77. For example, when the distance C is narrowed, the ink rail body 5 is advanced by rotating the adjusting member 75 leftward. Similarly, the ink rail body 5 is retreated by rotating the adjusting member 75 rightward. Thus, the ink rail body 5 is moved forward and backward along the horizontal upper face of the inclination member 4. Therefore, the ink supplying surface 53 of the ink rail body 5 relatively approaches the outer circumferential surface of the fountain roller F in the horizontal direction and is relatively separated from this outer circumferential surface in the horizontal direction. Thus, it is possible to adjust the distance in a direction perpendicular to a moving direction provided by the first adjusting means, i.e., in the horizontal direction. After this operation is performed, the bolt 52 is again softly fastened and temporarily fixed.

As mentioned above, the position of the ink adjusting face 53 with respect to the outer circumferential surface of the fountain roller F is adjusted in the thickness direction of the inclination member 4, i.e., the vertical direction by operating the first adjusting means 6, and is also adjusted in a direction perpendicular to the moving direction provided by the first adjusting means, i.e., in the horizontal direction by operating the second adjusting means 7. Each of these operations in both the directions is repeatedly performed a suitable number of times so that a desirable precise distance C is obtained. The distance C between the outer circumferential surface of the fountain roller F and the ink supplying surface 53 of the ink rail body 5 is fixed by reliably fastening the bolts 42 and 52 in a setting state of the distance C.

The distance C between the outer circumferential surface of the fountain roller F and the ink supplying surface 53 can be uniformly set and can be also set to a gradually changing state above and below the ink adjusting face 53 by suitably operating the first adjusting means 6 and the second adjusting means 7.

The length of an arc of the concave curved surface of the ink supplying surface 53 in the first and second embodiment modes is set to ¼ to 1/36 times a circumferential length of the fountain roller F. Both ends of the arc of the concave curved surface can be included within one quadrant determined by two adjusting and moving perpendicular directions. Accordingly, it is sufficient to make each of adjusting movements of the first and second adjusting means by paying attention to one end of the arc of the concave curved surface. Since the concave curved surface of the ink supplying surface 53 is formed as a concave curved surface having a relatively short arc, the concave curved surface of the ink supplying surface 53 is easily processed precisely. Therefore, it is very easy to precisely set the distance C between the outer circumferential surface of the fountain roller F and the ink supplying surface 53. Further, the ink rail body 5 can be made light in weight. Accordingly, it is easy to make a work for adjusting the distance C by making the ink supplying surface 53 approach the outer circumferential surface of the fountain roller F and separate from this outer circumferential surface. Therefore, there is almost no danger of making the ink supplying surface 53 come in contact with the outer circumferential surface of the fountain roller F in error during the adjusting work. Accordingly, a person can easily set the precise distance C even when this person is not a skilled worker. A maintenance work can be also easily made.

Further, in an embodiment mode of an attaching work, the pedestal 3 of the supporting member 2 is located in the operating position and the inclination member 4 is attached onto the pedestal 3 and is adjusted and fixed by the first adjusting means 6 in advance such that the upper face of the inclination member 4 is horizontal and has a predetermined height. Next, the ink rail body 5 is attached to the upper face of the inclination member 4 set to the horizontal face. Thus, the distance C between the outer circumferential surface of the fountain roller F and the ink supplying surface 53 can be set by only a moving adjustment of the ink rail body 5 in the horizontal direction using the second adjusting means 7 so that the distance C can be more easily set.

Effects of the present invention are provided as follows.

(1) It is possible to very easily make an adjusting work for setting the distance between the outer circumferential surface of the fountain roller and the ink supplying surface of the ink rail body to a suitable precise distance.

(2) Since the adjusting work of the distance is easily made, a burden to a worker is reduced. Further, working efficiency is improved since the adjusting work can be made even when no worker is a skilled worker.

(3) Ink can be stably supplied and damaged paper can be reduced.

(4) Printing quality can be improved.

(5) Fears of damaging the outer circumferential surface of the fountain roller and the ink supplying surface of the ink rail body are greatly reduced in reassembly and readjusting work.

(6) In the invention of claim 2, an attaching work of the ink rail body is more easily made and is safely made for a short time even when no worker is a skilled worker.

(7) In the invention of claim 3, the ink rail body is divided into units each having a suitable length so that the distance C can be adjusted every divided unit. For example, when the ink rail body is divided into units each having a length corresponding to one page unit of a newspaper, the distance C can be individually adjusted and set every page.

What is claimed is:

1. An ink rail for a printing press having an operating position in proximity to an outer circumferential surface of a fountain roller and a non-operating position separated from the outer circumferential surface of the fountain roller, the ink rail comprising:

an ink rail body having at least a length corresponding to a printing width of the printing press, and having an ink discharge port and an ink supplying surface constructed by a concave curved surface movable to a position adjacent the outer circumferential surface of the fountain roller at a suitable distance;

an inclination member arranged on a lower face of the ink rail body and having an angle of inclination between upper and lower faces of the inclination member and an inclining direction set to a transversal direction of the ink rail body;

a pedestal for supporting the inclination member;

a supporting member for supporting the pedestal;

first adjusting means for moving the inclination member with respect to the pedestal and capable of moving the ink supplying surface of the ink rail body in a first direction of the inclination member with respect to the outer circumferential surface of the fountain roller; and second adjusting means for moving the ink rail body with respect to the inclination member and capable of moving the ink supplying surface of the ink rail body in a direction different than a moving direction provided by the first adjusting means with respect to the outer circumferential surface of the fountain roller;

the distance between the outer circumferential surface of the fountain roller in the operating position of the ink rail and the ink supplying surface of the ink rail body is adjusted by operating the first and second adjusting means.

2. An ink rail for a printing press having an operating position in proximity to an outer circumferential surface of a fountain roller and a non-operating position separated from the outer circumferential surface of the fountain roller, the ink rail comprising:

an ink rail body having at least a length corresponding to a printing width of the printing press, and having an ink discharge port and an ink supplying surface constructed by a concave curved surface movable to a position adjacent to the outer circumferential surface of the fountain roller at a suitable distance;

an inclination member arranged on a lower face of the ink rail body and having an angle of inclination between a lower face of the inclination member and an upper face of the inclination member set to be horizontal in the operating position, and also having an inclining direction set to a transversal direction of the ink rail body;

a pedestal for supporting the inclination member;

a supporting member for supporting the pedestal;

first adjusting means capable of moving the ink supplying surface of the ink rail body in a first direction with respect to the outer circumferential surface of the fountain roller by moving the inclination member with respect to the pedestal; and second adjusting means capable of moving the ink supplying surface of the ink rail body in a second direction with respect to the outer circumferential surface of the fountain roller by moving the ink rail body with respect to the inclination member;

the distance between the outer circumferential surface of the fountain roller in the operating position of the ink rail and the ink supplying surface of the ink rail body is adjusted by operating the first and second adjusting means.

3. The ink rail for the printing press as defined in claim 1, wherein the ink rail body and the inclination member are divided into plural portions in a longitudinal direction of the fountain roller, and the distances between the outer circumferential surface of the fountain roller in the operating position of the ink rail and the ink supplying surfaces of the plural ink rail bodies can be individually adjusted.

4. The ink rail for the printing press as defined in claim 2, wherein the ink rail body and the inclination member are divided into plural portions in a longitudinal direction of the fountain roller, and the distances between the outer circumferential surface of the fountain roller in the operating position of the ink rail and the ink supplying surfaces of the plural ink rail bodies can be individually adjusted.

* * * * *